US008362866B2

(12) United States Patent
Matsuura et al.

(10) Patent No.: US 8,362,866 B2
(45) Date of Patent: Jan. 29, 2013

(54) COIL COMPONENT

(75) Inventors: Hitoshi Matsuura, Takasaki (JP); Tomomi Kobayashi, Takasaki (JP); Yoshikazu Okino, Takasaki (JP); Hidemi Iwao, Takasaki (JP); Kenichiro Nogi, Takasaki (JP); Kenji Otake, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/351,078

(22) Filed: Jan. 16, 2012

(65) Prior Publication Data

US 2012/0188049 A1 Jul. 26, 2012

(30) Foreign Application Priority Data

Jan. 20, 2011 (JP) ..... 2011-009886
Oct. 24, 2011 (JP) ..... 2011-232371
Oct. 28, 2011 (JP) ..... 2011-236738

(51) Int. Cl.
*H01F 5/00* (2006.01)

(52) U.S. Cl. ..... 336/200

(58) Field of Classification Search ..... 336/65, 336/90, 96, 200, 232–233
See application file for complete search history.

(56) References Cited

U.S. PATENT DOCUMENTS 5,350,628 A * 9/1994 Kugimiya et al. ..... 428/307.3
6,784,782 B2 8/2004 Inoue et al.
6,888,435 B2 * 5/2005 Inoue et al. ..... 336/83
2008/0029300 A1 2/2008 Harada et al.
2011/0024670 A1 2/2011 Otsuki et al.
2011/0267167 A1 11/2011 Ogawa et al.
2012/0038449 A1 2/2012 Ogawa et al.
2012/0070567 A1 * 3/2012 Watanabe et al. ..... 427/127
2012/0138844 A1 * 6/2012 Watanabe et al. ..... 252/62.55

FOREIGN PATENT DOCUMENTS

JP H09-074011 A 3/1997
JP 2000-030925 A 1/2000
JP 2001-011563 A 1/2001
JP 2001-118725 A 4/2001
JP 2002-305108 A 10/2002
JP 2002-313620 A 10/2002
JP 2002-343618 A 11/2002
JP 2007-019134 A 1/2007
JP 2007-027354 A 2/2007
JP 2007-123703 A 5/2007
JP 2007-299871 A 11/2007
JP 2008-028162 A 2/2008
JP 2008-041961 A 2/2008
JP 2008-195986 A 8/2008
JP 2009-088496 A 4/2009
JP 2009-088502 A 4/2009
JP 2011-249774 A1 12/2011
WO 2009/128425 A1 10/2009

* cited by examiner

*Primary Examiner* — Tuyen Nguyen
(74) *Attorney, Agent, or Firm* — Law Office of Katsuhiro Arai

(57) ABSTRACT

A coil component is of the type where a helical coil is directly contacting a magnetic body, which is still capable of meeting the demand for electrical current amplification. A coil component, comprising a magnetic body mainly constituted by magnetic alloy grains, and a coil formed on the magnetic body; wherein an oxide film of the magnetic alloy grains is present on the surface of each of the magnetic alloy grains, and based on grain size by volume standard, the magnetic alloy grains have a d50 in a range of 3.0 to 20.0 μm, d10/d50 in a range of 0.1 to 0.7, and d90/d50 in a range of 1.4 to 5.0.

19 Claims, 5 Drawing Sheets

COIL COMPONENT

BACKGROUND

1. Field of the Invention

The present invention relates to a coil component structured in such a way, among others, that a helical coil is covered with a magnetic body.

2. Description of the Related Art

Coil components (so-called "inductance components"), representative examples of which are inductors, choke coils and transformers, are structured in such a way that a helical coil is covered with a magnetic body, an insulating covering conductive wire is wound around a magnetic body, or the like. For the magnetic body covering the coil, Ni—Cu—Zn ferrite and other ferrites (=ceramics whose main constituent is iron oxide) are generally used.

In recent years, there has been a demand for coil components of this type offering electrical current amplification (=higher rated current) and, to meet this need, switching the material for the magnetic body from conventional ferrites to Fe—Cr—Si alloy is being examined (refer to patent Literature 1).

This Fe—Cr—Si alloy has a higher saturated magnetic flux density than conventional ferrites, but its volume resistivity is much lower than conventional ferrites. In other words, to switch the material for magnetic body from conventional ferrites to Fe—Cr—Si alloy for a coil component of the type where the helical coil is directly contacting the magnetic body, such as a coil component of the laminated type or the powder-compacted type, an ingenious idea is needed to bring the volume resistivity of the magnetic body itself, which is constituted by Fe—Cr—Si alloy grains, closer to the volume resistivity of the magnetic body constituted by ferrite grains, or preferably increase the volume resistivity of the former beyond that of the latter.

In essence, without ensuring a high volume resistivity of the magnetic body itself which is constituted by Fe—Cr—Si alloy grains, the saturated magnetic flux density of the material cannot be utilized to increase the saturated magnetic flux density of the component and, due to the phenomenon of current leaking from the coil to the magnetic body and disturbing the magnetic field, the inductance of the component itself will drop.

Note that Patent Literature 1 mentioned above discloses a method for manufacturing a magnetic body for coil component of the laminated type, which comprises laminating a magnetic body layer formed by a magnetic paste containing Fe—Cr—Si alloy grains as well as a glass component, with a conductor pattern, baking the laminate in a nitrogen atmosphere (=reducing atmosphere), and then impregnating the baked laminate with a thermo-setting resin.

However, this manufacturing method allows the glass component in the magnetic paste to remain in the magnetic body, and this glass component in the magnetic body reduces the volume ratio of Fe—Cr—Si alloy grains, which in turn lowers the saturated magnetic flux density of the component itself.

Any discussion of problems and solutions involved in the related art has been included in this disclosure solely for the purposes of providing a context for the present invention, and should not be taken as an admission that any or all of the discussion were known at the time the invention was made.

PATENT LITERATURES

[Patent Literature 1] Japanese Patent Laid-open No. 2007-027354

SUMMARY

An object of the present invention is to provide a coil component of the type where a helical coil is directly contacting a magnetic body, which is still capable of meeting the demand for electrical current amplification.

To achieve the aforementioned object, the present invention provides a coil component as described below. The coil component proposed by the present invention has a magnetic body and a coil formed on this magnetic body. The coil should preferably be helical and it should preferably be contacting the magnetic body directly. The coil is covered with the magnetic body according to an embodiment of the present invention, or wound around the magnetic body serving as the magnetic core in another embodiment. The magnetic body is mainly constituted by magnetic alloy grains. The magnetic body may or may not contain a glass component. Based on grain size by volume standard, the magnetic alloy grains have a d50 in a range of 3.0 to 20.0 μm, d10/d50 in a range of 0.1 to 0.7, and d90/d50 in a range of 1.4 to 5.0. Preferably, the magnetic alloy grains are made of a Fe—Cr-M soft magnetic alloy (where M is a metal element more easily oxidized than Fe), and M is more preferably Si. An oxide film is present on the surface of each magnetic alloy grain. The oxide film may be present on a part of the magnetic alloy surface or over the entire surface. The oxide film is made of an oxide of magnetic alloy grain. Preferably, the oxide film is made of an oxide of Fe—Si-M soft magnetic alloy (where M is a metal element more easily oxidized than Fe), where the mol ratio of the metal element denoted by M relative to the Fe element is greater than the corresponding mol ratio in the magnetic alloy grain.

Preferably, the magnetic alloy grains have bonding portions via the oxide film present on the surface of adjacent magnetic alloy grains, and direct bonding portions of magnetic alloy grains in parts where no oxide film is present. Also, preferably, the number of magnetic alloy grains shown in a cross section of a group of magnetic alloy grains, or N, and the number of direct bonding portions of magnetic alloy grains, or B, have a B/N ratio of 0.1 to 0.5. These magnetic alloy grains are preferably obtained by forming, under an unheated condition, magnetic alloy grains not having oxide film at least on a part of the grain surface, and then applying heat treatment to generate an oxide film as well as bonds via the generated oxide film between adjacent magnetic alloy grains. Alternatively, the magnetic alloy grains are preferably obtained by forming multiple magnetic alloy grains manufactured according to the atomization method and then applying heat treatment in an oxidizing atmosphere.

According to the present invention, magnetic alloy grains constituting the magnetic body have an oxide film (=insulation film) of magnetic alloy grains on their surface, and magnetic alloy grains in the magnetic body directly bind with one another via the oxide film that serves as an insulation film, and also magnetic alloy grains near the coil adhere to the coil via the oxide film that serves as an insulation film, and for these reasons a high volume resistivity of the magnetic body mainly constituted by magnetic alloy grains can be ensured. In addition, when the magnetic body does not contain a glass component, the volume ratio of magnetic alloy grains does not drop, unlike when there is a glass component in the magnetic body, which prevents the saturated magnetic flux density of the component itself from dropping due to a lower volume ratio.

In other words, although the coil component is of the type where the coil is directly contacting the magnetic body, the saturated magnetic flux density of the component itself can be increased by effectively utilizing the saturated magnetic flux density of the magnetic alloy material, which helps meet the demand for electrical current amplification and also prevents the phenomenon of current leaking from the coil to the magnetic body and disturbing the magnetic field, which in turn prevents the inductance of the component itself from dropping.

The aforementioned object and other objects, constitution/characteristics and operation/effects of the present invention are made clear by the following explanations and attached drawings.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

| Description of the Symbols | |
|---|---|
| 1 | Magnetic alloy grain |
| 2 | Oxide film |
| 3 | Pore |
| 4 | Mixture of solvent and binder |
| 5 | Bond via oxide film |
| 6 | Direct bond of magnetic alloy grains |
| 10 | Coil component |
| 11 | Main component body |
| 12 | Magnetic body |
| 13 | Coil |
| 14, 15 | External terminal |
| 110 | Magnetic material |
| 111, 112 | Magnetic core |
| 114 | External conductive film |
| 115 | Coil |

DETAILED DESCRIPTION

The coil component proposed by the present invention has a magnetic body and a coil formed on this magnetic body. Examples of such coil component include a coil component of the laminated type (laminated inductor, etc.) and coil component comprising a conductive wire wound around a magnetic body serving as the magnetic core. The following explains the characteristics of the present invention by explaining a typical coil component.

[Example of Specific Structure of Coil Component of Laminated Type]

First, an example of specific structure where the present invention is applied to a coil component of the laminated type is explained by referring to FIGS. 1 to 5.

Figure 1:
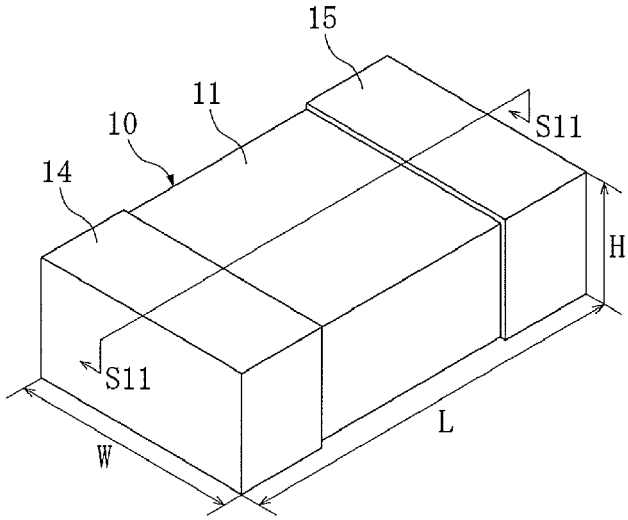
FIG. 1 is an external perspective view of a coil component of the laminated type.
Figure 2:
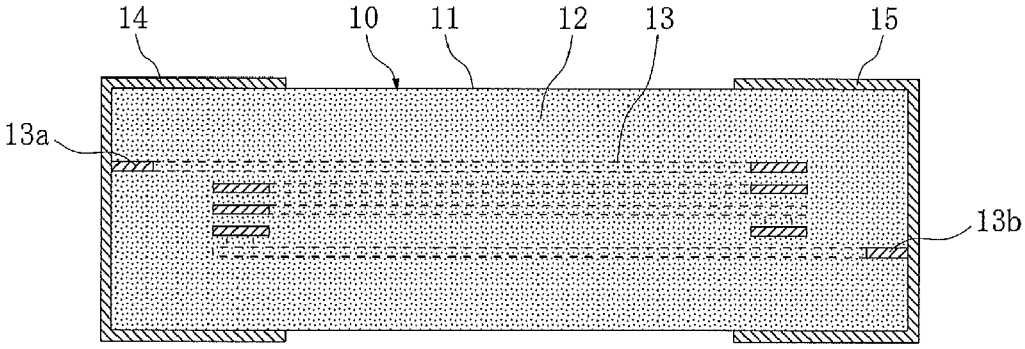
FIG. 2 is an enlarged sectional view taken along line S11-S11 in FIG. 1.

A coil component 10 shown in FIG. 1 has a rectangular solid shape of approx. 3.2 mm in length L, approx. 1.6 mm in width W, and approx. 0.8 mm in height H. This coil component 10 has a main component body 11 of rectangular solid shape and a pair of external terminals 14, 15 provided at both ends in the length direction of the main component body 11. As shown in FIG. 2, the main component body 11 has a magnetic body 12 of rectangular solid shape and a helical coil 13 covered with the magnetic body 12, where one end of the coil 13 is connected to the external terminal 14, while the other end is connected to the external terminal 15.

Figure 3:
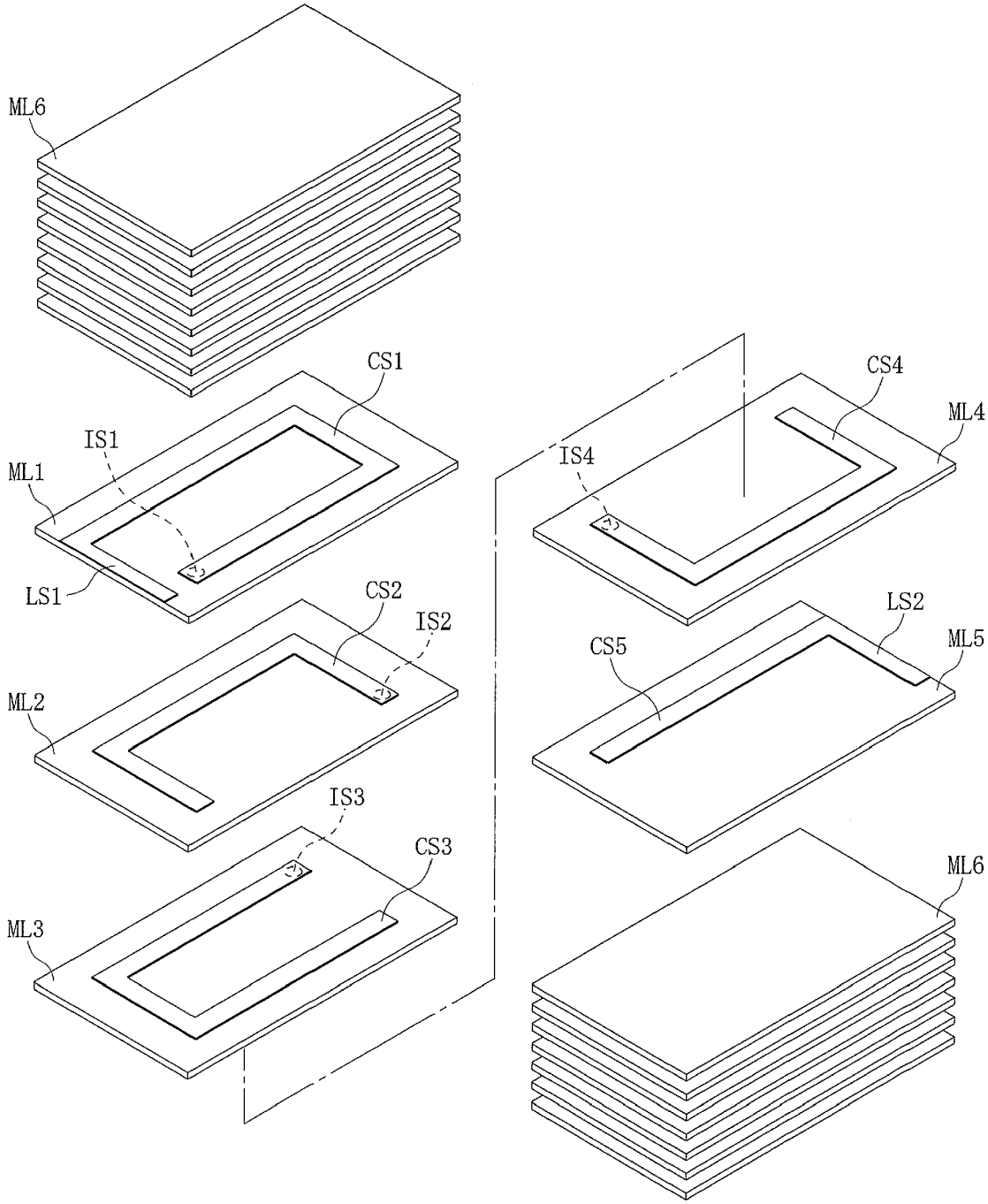
FIG. 3 is an exploded view of the component shown in FIG. 1.

As shown in FIG. 3, the magnetic body 12 is structured in such a way that a total of 20 layers of magnetic layers ML1 to ML6 are put together and it has a length of approx. 3.2 mm, width of approx. 1.6 mm, and thickness (height) of approx. 0.8 mm. The length, width and thickness of each of the magnetic layers ML1 to ML6 are approx. 3.2 mm, approx. 1.6 mm and approx. 40 μm, respectively. This magnetic body 12 is mainly constituted by Fe—Cr—Si alloy grains and does not contain a glass component in this embodiment. The composition of the Fe—Cr—Si alloy grains is 88 to 96.5 percent by weight of Fe, 2 to 8 percent by weight of Cr, and 1.5 to 7 percent by weight of Si.

Figure 4:
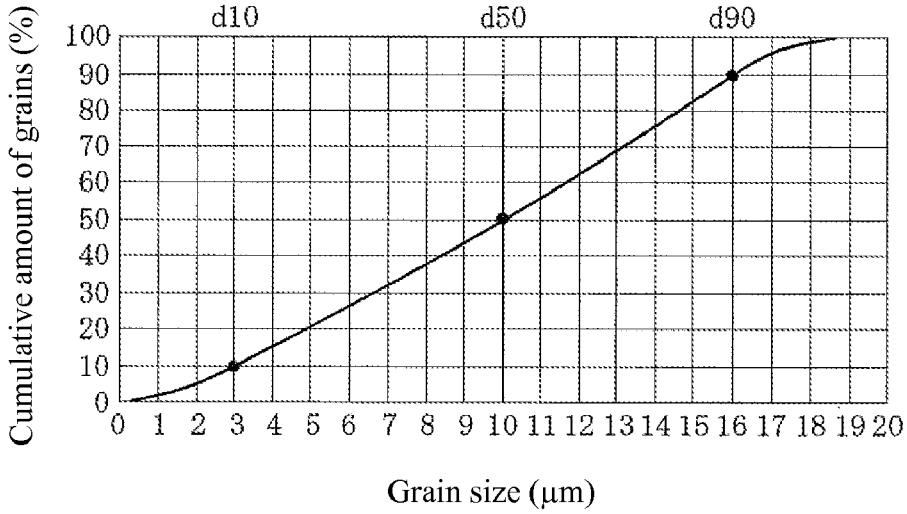
FIG. 4 is a graph showing the granularity distribution of grains constituting the magnetic body shown in FIG. 2.
Figure 5:
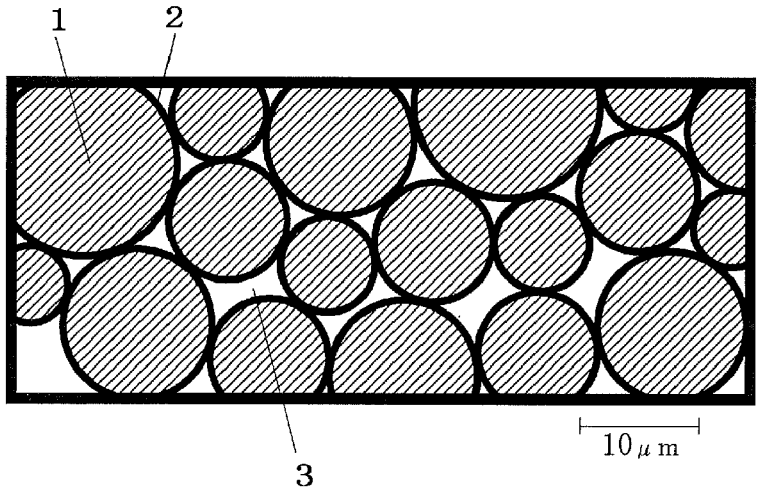
FIG. 5 is a schematic view showing the condition of grains according to an image obtained by observing the magnetic body in FIG. 2 with a transmission electron microscope.

As shown in FIG. 4, Fe—Cr—Si alloy grains constituting the magnetic body 12 have a d50 (median diameter) of 10 μm, d10 of 3 μm and d90 of 16 μm when their grain size is considered based on volume, where d10/d50 is 0.3 and d90/d50 is 1.6. Also as shown in FIG. 5, an oxide film (=insulation film) 2 of Fe—Cr—Si alloy grains is present on the surface of each Fe—Cr—Si alloy grain 1, and Fe—Cr—Si alloy grains 1 in the magnetic body 12 bind with one another via the oxide film 2 that serves as an insulation film, while Fe—Cr—Si alloy grains 1 near the coil 13 adhere to the coil 13 via the oxide film 2 that serves as an insulation film. This oxide film 2 has been confirmed to contain at least the magnetic substance $Fe_3O_4$ and non-magnetic substances $Fe_2O_3$ and $Cr_2O_3$.

It should be noted that FIG. 4 shows a granularity distribution measured with a grain-size/granularity-distribution measuring apparatus utilizing the laser diffraction scattering method (Microtrack manufactured by Nikkiso Co., Ltd.). FIG. 5 shows a schematic view of the condition of grains according to an image obtained by observing the magnetic body 12 with a transmission electron microscope. Fe—Cr—Si alloy grains constituting the magnetic body 12 are not actually perfect spheres, but all grains here are depicted as spheres in order to illustrate that their grain sizes have a distribution. Also, while the thickness of the oxide film present on the surface of each grain actually varies over a range of 0.05 to 0.2 μm, the oxide film here is depicted as having a uniform thickness throughout in order to illustrate that the oxide film 2 is present on the grain surface.

As shown in FIG. 3, the coil 13 is structured in such a way that a total of five coil segments CS1 to CS5, and a total of four relay segments IS1 to IS4 connecting the coil segments CS1 to CS5, are put together in a helical pattern and the number of windings is approx. 3.5. This coil 13 is mainly constituted by Ag grains. When their grain size is considered based on volume, Ag grains have a d50 (median diameter) of 5 μm.

The four coil segments CS1 to CS4 have a C shape, while one coil segment CS5 has a thin strip shape. Each of the coil segments CS1 to CS5 has a thickness of approx. 20 μm and width of approx. 0.2 mm. The top coil segment CS1 has an L-shaped leader part LS1 which is continuously formed with the coil segment and utilized to connect to external terminal 14, while the bottom coil segment CS5 also has an L-shaped leader part LS2 which is continuously formed with the coil segment and utilized to connect to external terminal 15. Each of the relay segments IS1 to IS4 has a column shape that passes through the corresponding magnetic layer ML1, ML2, ML3 or ML4, where each segment has a bore of approx. 15 μm.

As shown in FIGS. 1 and 2, the external terminals 14, 15 cover each end face, in the length direction, of the main component body 11 as well as four side faces near the end face, and have a thickness of approx. 20 μm. The one external terminal 14 connects to the edge of the leader part LS1 of the top coil segment CS1, while the other external terminal 15 connects to the edge of the leader part LS2 of the bottom coil segment CS5. These external terminals 14, 15 are mainly constituted by Ag grains. When their grain size is considered based on volume, Ag grains have a d50 (median diameter) of 5 μm.

[Example of Specific Method for Manufacturing Coil Component]

Next, an example of a specific method for manufacturing the aforementioned coil component 10 is explained by referring to FIGS. 3, 5, 6 and 7.

When manufacturing the aforementioned coil component 10, a doctor blade, die coater, or other coating machine (not illustrated) is used to coat a prepared magnetic paste onto the surface of a plastic base film (not illustrated), after which the coated base film is dried at approx. 80° C. for approx. 5 minutes using a hot-air dryer or other dryer (not illustrated), to create first to sixth sheets that correspond to the magnetic layers ML1 to ML6 (refer to FIG. 3), respectively, and have a size appropriate for multiple-part processing.

The composition of the magnetic paste used here is 85 percent by weight of Fe—Cr—Si alloy grains, 13 percent by weight of butyl carbitol (solvent) and 2 percent by weight of polyvinyl butyral (binder), where Fe—Cr—Si alloy grains have the d50 (median diameter), d10 and d90 as mentioned earlier. It was confirmed with an electron microscope that the Fe—Cr—Si alloy grains used here had no oxide film at least on a part of their grain surface.

Next, a stamping machine, laser processing machine, or other piercing machine (not illustrated) is used to pierce the first sheet corresponding to the magnetic layer ML1 (refer to FIG. 3), to form through holes corresponding to the relay segment IS1 (refer to FIG. 3) in a specified layout. Similarly, the second to fourth sheets corresponding to the magnetic layers ML2 to ML4 (refer to FIG. 3) are pierced to form through holes corresponding to the relay segments IS2 to IS4 (refer to FIG. 3) in specified layouts.

Next, a screen printer, gravure printer or other printer (not illustrated) is used to print a prepared conductive paste onto the surface of the first sheet corresponding to the magnetic layer ML1 (refer to FIG. 3), after which the printed sheet is dried at approx. 80° C. for approx. 5 minutes using a hot-air dryer or other dryer (not illustrated), to create a first printed layer corresponding to the coil segment CS1 (refer to FIG. 3) in a specified layout. Similarly, second to fifth printed layers corresponding to the coil segments CS2 to CS5 (refer to FIG. 3) are created in specified layouts on the surfaces of the second to fifth sheets corresponding to the magnetic layers ML2 to ML5 (refer to FIG. 3).

The composition of the conductive paste used here is 85 percent by weight of Ag grains, 13 percent by weight of butyl carbitol (solvent) and 2 percent by weight of polyvinyl butyral (binder), where Ag grains have the d50 (median diameter) as mentioned earlier.

The through holes formed in specified layouts in the first to fourth sheets corresponding to the magnetic layers ML1 to ML4 (refer to FIG. 3) are positioned in a manner overlapping with the edges of the first to fourth printed layers in specified layouts, respectively, so that part of the conductive paste is filled in each through hole when the first to fourth printed layers are created, to form first to fourth filled parts corresponding to the relay segments IS1 to IS4 (refer to FIG. 3).

Next, a suction transfer machine and press machine (both not illustrated) are used to stack in the order shown in FIG. 3 and thermally compress the first to fourth sheets (corresponding to the magnetic layers ML1 to ML4) each having a printed layer and filled part, the fifth sheet (corresponding to the magnetic layer ML5) having only a printed layer, and the sixth sheet (corresponding to the magnetic layer ML6) having neither a printed layer nor filled part, to create a laminate.

Next, a dicing machine, laser processing machine, or other cutting machine (not illustrated) is used to cut the laminate to the size of the main component body to create a chip before heat treatment (including a magnetic body and coil before heat treatment).

Next, a baking furnace or other heat treatment machine (not illustrated) is used to heat-treat multiple chips before heat treatment in batch in an atmosphere or other oxidizing atmosphere. This heat treatment includes a binder removal process and an oxide film forming process, where the binder removal process is implemented under conditions of approx. 300° C. for approx. 1 hour, while the oxide film forming process is implemented under conditions of approx. 750° C. and approx. 2 hours.

Figure 6:
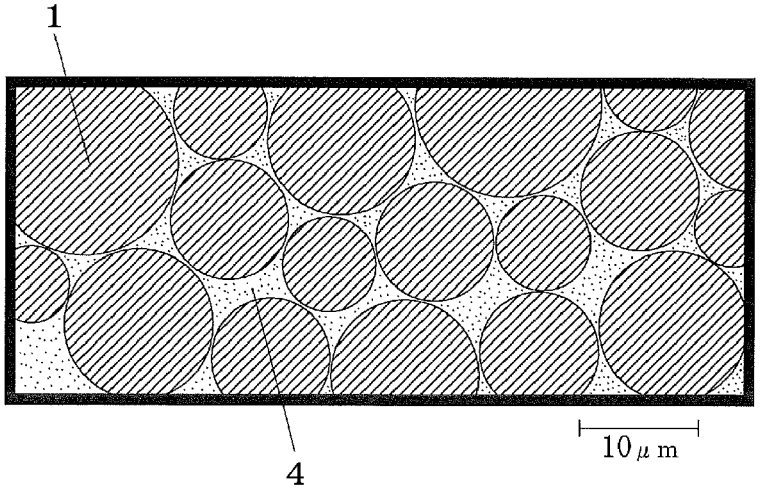
FIG. 6 is a schematic view showing the condition of grains according to an image obtained by observing the magnetic body before the binder removal process with a transmission electron microscope.
Figure 7:
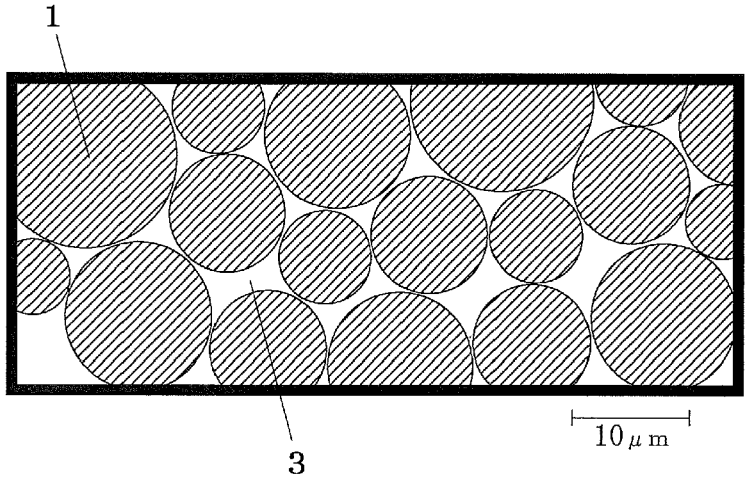
FIG. 7 is a schematic view showing the condition of grains according to an image obtained by observing the magnetic body after the binder removal process with a transmission electron microscope.

As shown in FIG. 6, before the binder removal process, the chip before heat treatment has many fine voids between Fe—Cr—Si alloy grains 1 in the magnetic body before heat treatment and, while these fine voids are filled with a mixture 4 of solvent and binder, this mixture is lost in the binder removal process and therefore by the time the binder removal process is completed, these fine voids have changed to pores 3, as shown in FIG. 7. Also, while many fine voids are present between Ag grains in the coil before heat treatment and these fine voids are filled with a mixture of solvent and binder, this mixture is lost in the binder removal process.

In the oxide film forming process after the binder removal process, Fe—Cr—Si alloy grains in the magnetic body before heat treatment gather closely to create the magnetic body 12 (refer to FIGS. 1 and 2), as shown in FIG. 5, while at the same time the oxide film 2 of Fe—Cr—Si alloy grains is formed on the surface of each grain 1. Also, Ag grains in the coil before heat treatment are sintered to create the coil 13 (refer to FIGS. 1 and 2), thereby creating the main component body 11 (refer to FIGS. 1 and 2).

FIGS. 6 and 7 provide schematic views of the condition of grains according to images obtained by observing the magnetic bodies before and after the binder removal process with a transmission electron microscope. Fe—Cr—Si alloy grains 1 constituting the magnetic body before heat treatment are actually not perfect spheres, but all grains here are depicted as spheres to maintain consistency with FIG. 5.

Next, a dip coater, roller coater, or other coater (not illustrated) is used to coat a prepared conductive paste onto both ends in the length direction of the main component body 11, and then the coated main component body is baked in a baking furnace or other heat treatment machine (not illustrated) under conditions of approx. 600° C. for approx. 1 hour to remove the solvent and binder in the baking process, while also sintering the Ag grains, to create the external terminals 14, 15 (refer to FIGS. 1 and 2).

The composition of the conductive paste used here is 85 percent by weight of Ag grains, 13 percent by weight of butyl carbitol (solvent) and 2 percent by weight of polyvinyl butyral (binder), where Ag grains have the d50 (median diameter) as mentioned earlier.

[Effects]

Next, the effects of the aforementioned coil component 10 are explained by referring to Sample No. 4 in Table 1.

TABLE 1

| Sample | d50 (μm) | d10 (μm) | d90 (μm) | d10/d50 | d90/d50 | Volume resistivity (Ω · cm) | | L × Idc1 (μH · A) | |
|---|---|---|---|---|---|---|---|---|---|
| No. 1 | 10 | 0.5 | 16 | 0.05 | 1.6 | $1.1 \times 10^9$ | ○ | 4.7 | X |
| No. 2 | 10 | 1 | 16 | 0.1 | 1.6 | $9.5 \times 10^8$ | ○ | 6.5 | ○ |
| No. 3 | 10 | 2 | 16 | 0.2 | 1.6 | $6.0 \times 10^8$ | ○ | 7.2 | ○ |
| No. 4 | 10 | 3 | 16 | 0.3 | 1.6 | $5.2 \times 10^8$ | ○ | 8.3 | ○ |
| No. 5 | 10 | 4 | 16 | 0.4 | 1.6 | $4.1 \times 10^8$ | ○ | 8.3 | ○ |
| No. 6 | 10 | 5 | 16 | 0.5 | 1.6 | $9.0 \times 10^7$ | ○ | 8.4 | ○ |
| No. 7 | 10 | 6 | 16 | 0.6 | 1.6 | $5.6 \times 10^7$ | ○ | 8.4 | ○ |
| No. 8 | 10 | 7 | 16 | 0.7 | 1.6 | $2.1 \times 10^7$ | ○ | 8.4 | ○ |
| No. 9 | 10 | 8 | 16 | 0.8 | 1.6 | $8.5 \times 10^6$ | X | 8.5 | ○ |
| No. 10 | 10 | 9 | 16 | 0.9 | 1.6 | $3.1 \times 10^6$ | X | 8.5 | ○ |
| No. 11 | 10 | 3 | 13 | 0.3 | 1.3 | $1.0 \times 10^9$ | ○ | 5.0 | X |
| No. 12 | 10 | 3 | 14 | 0.3 | 1.4 | $9.5 \times 10^8$ | ○ | 5.8 | ○ |
| No. 13 | 10 | 3 | 15 | 0.3 | 1.5 | $7.3 \times 10^8$ | ○ | 7.2 | ○ |
| No. 4 | 10 | 3 | 16 | 0.3 | 1.6 | $5.2 \times 10^8$ | ○ | 8.3 | ○ |
| No. 14 | 10 | 3 | 17 | 0.3 | 1.7 | $3.7 \times 10^8$ | ○ | 8.3 | ○ |
| No. 15 | 10 | 3 | 18 | 0.3 | 1.8 | $2.0 \times 10^8$ | ○ | 8.3 | ○ |
| No. 16 | 10 | 3 | 19 | 0.3 | 1.9 | $1.0 \times 10^8$ | ○ | 8.3 | ○ |
| No. 17 | 10 | 3 | 20 | 0.3 | 2.0 | $8.7 \times 10^7$ | ○ | 8.3 | ○ |
| No. 18 | 10 | 3 | 30 | 0.3 | 3.0 | $4.6 \times 10^7$ | ○ | 8.4 | ○ |
| No. 19 | 10 | 3 | 40 | 0.3 | 4.0 | $2.6 \times 10^7$ | ○ | 8.4 | ○ |
| No. 20 | 10 | 3 | 50 | 0.3 | 5.0 | $1.1 \times 10^7$ | ○ | 8.5 | ○ |
| No. 21 | 10 | 3 | 55 | 0.3 | 5.5 | $7.0 \times 10^6$ | X | 8.5 | ○ |
| No. 22 | 10 | 3 | 60 | 0.3 | 6.0 | $4.2 \times 10^6$ | X | 8.6 | ○ |

With the aforementioned coil component 10, Fe—Cr—Si alloy grains constituting the magnetic body 12 each have an oxide film (=insulation film) of Fe—Cr—Si alloy grains on the surface, and Fe—Cr—Si alloy grains in the magnetic body 12 bind with one another via the oxide film that serves as an insulation film, while Fe—Cr—Si alloy grains near the coil 13 adhere to the coil 13 via the oxide film that serves as an insulation film, and therefore a high volume resistivity can be ensured for the magnetic body itself which is mainly constituted by Fe—Cr—Si alloy grains. Also, the magnetic body 12 does not contain a glass component, so the volume ratio of Fe—Cr—Si alloy grains does not drop, unlike when there is a glass component in the magnetic body 12, which prevents the saturated magnetic flux density of the component itself from dropping due to a lower volume ratio.

In other words, although the coil component is of the type where the coil 13 is directly contacting the magnetic body 12, the saturated magnetic flux density of the component itself can be increased by effectively utilizing the saturated magnetic flux density of the Fe—Cr—Si alloy material, which helps meet the demand for electrical current amplification and also prevents the phenomenon of current leaking from the coil 13 to the magnetic body 12 and disturbing the magnetic field, which in turn prevents the inductance of the component itself from dropping.

This effect can also be demonstrated by the volume resistivity and L×Idc1 of Sample No. 4 in Table 1 that corresponds to the aforementioned coil component 10. Each volume resistivity (Ω·cm) shown in Table 1 indicates the volume resistivity of the magnetic body 12 itself, measured with a commercial LCR meter. On the other hand, each L×Idc1 (μH·A) shown in Table 1 indicates the product of the initial inductance (L) and the direct-current bias current (Idc1) when the initial inductance (L) has dropped by 20%, measured at a measurement frequency of 100 kHz using a commercial LCR meter.

Now, the acceptance judgment criteria for volume resistivity and L×Idc1 are explained. Given the fact that conventional coil components generally use Ni—Cu—Zn ferrite, among other ferrites, for their magnetic body, a coil component was created based on the same structure and using the same manufacturing method as those used by the aforementioned coil component 10, except that "Ni—Cu—Zn ferrite grains with a d50 (median diameter) of 10 μm, when their grain size is considered based on volume, were used instead of Fe—Cr—Si alloy grains" and that "a baking process was adopted under conditions of approx. 900° C. for approx. 2 hours, instead of the oxide film forming process" (the obtained coil component is hereinafter referred to as the "comparative coil component").

When the volume resistivity and L×Idc1 of the magnetic body of this comparative coil component were measured in the same manners as mentioned above, the volume resistivity was $5.0\times10^6$ Ω·cm, while L×Idc1 was 5.2 μH·A. With conventional coil components using Ni—Cu—Zn ferrite grains, however, the volume resistivity of the magnetic body is increased to $1.0\times10^7$ Ω·cm or higher by manipulating the grain composition, impregnating it with resin, or using other methods, and accordingly the acceptance judgment criterion for volume resistivity was set to "$1.0\times10^7$ Ω·cm"; i.e., values equal to or higher than this criterion value were judged "acceptable (○)," while those lower than the criterion value were judged "unacceptable (X)." Meanwhile, the acceptance judgment criterion for L×Idc1 was set to the measured value of L×Idc1 of the comparative coil component, or specifically "5.2 μH·A"; i.e., values higher than this criterion value were judged "acceptable (○)," while those equal to or lower than the criterion value were judged "unacceptable."

As evident from the volume resistivity and L×Idc1 of Sample No. 4, the volume resistivity of Sample No. 4 corresponding to the aforementioned coil component 10 is $5.2\times10^8$ Ω·cm, which is higher than the aforementioned acceptance judgment criterion for volume resistivity ($1.0\times10^7$ Ω·cm), while L×Idc1 of Sample No. 4 corresponding to the aforementioned coil component 10 is 8.3 μH·A, which is higher than the aforementioned acceptance judgment criterion for L×Idc1 (5.2 μH·A), and therefore these values demonstrate the aforementioned effects.

[Verification of Optimal Granularity Distribution]

Next, the result of verification of an optimal granularity distribution (d10/d50 and d90/d50) of Fe—Cr—Si alloy grains constituting the magnetic body 12 of the aforementioned coil component 10 (Sample No. 4) is explained by referring to Table 1.

With the aforementioned coil component 10 (Sample No. 4), the Fe—Cr—Si alloy grains used to constitute the magnetic body 12 had a d50 (median diameter) of 10 μm, d10 of 3 μm and d90 of 16 μm when their grain size was considered based on volume. Whether or not effects similar to those explained above could be obtained using grains of a different granularity distribution (d10/d50 and d90/d50) was evaluated.

Sample Nos. 1 to 3 and 5 to 10 shown in Table 1 are coil components having the same structure and made by the same manufacturing method as those used by the aforementioned coil component 10, except that "Fe—Cr—Si alloy grains having a different d10 value from that of the aforementioned coil component 10 (Sample No. 4) were used." Also, Sample Nos. 11 to 22 shown in Table 1 are coil components having the same structure and made by the same manufacturing method as those used by the aforementioned coil component 10 (Sample No. 4), except that "Fe—Cr—Si alloy grains having a different d90 value from that of the aforementioned coil component 10 (Sample No. 4) were used."

As evident from the volume resistivity and L×Idc1 values of Sample Nos. 1 to 10, a volume resistivity higher than the aforementioned acceptance judgment criterion for volume resistivity ($1.0\times10^7$ Ω·cm) can be obtained as long as d10 is 7 μm or less, while a L×Idc1 higher than the aforementioned acceptance judgment criterion for L×Idc1 (5.2 μH·A) can be obtained as long as d10 is 1 μm or more. In other words, excellent volume resistivity and L×Idc1 can be obtained as long as d10 is in a range of 1 to 7.0 μm (d10/d50 is in a range of 0.1 to 0.7).

Also, as is evident from the volume resistivity and L×Idc1 values of Sample Nos. 11 to 22, a volume resistivity higher than the aforementioned acceptance judgment criterion for volume resistivity ($1.0\times10^7$ Ω·cm) can be obtained as long as d90 is 50 μm or less, while a L×Idc1 higher than the aforementioned acceptance judgment criterion for L×Idc1 (5.2 μH·A) can be obtained as long as d90 is 14 μm or more. In other words, excellent volume resistivity and L×Idc1 can be obtained as long as d90 is in a range of 14 to 50 μm (d90/d50 is in a range of 1.4 to 5.0).

In essence, the above confirms that, as long as d10/d50, when the grain size is considered based on volume, is in a range of 0.1 to 0.7 and d90/d50 is in a range of 1.4 to 5.0, Fe—Cr—Si alloy grains whose granularity distribution (d10/d50 and d90/d50) is different can be used to achieve the same effects as mentioned above.

[Verification of Optimal Median Diameter]

Next, the result of verification of optimal median diameter (d50) of Fe—Cr—Si alloy grains constituting the magnetic body 12 of the aforementioned coil component 10 (Sample No. 4) is explained by referring to Table 2.

TABLE 2

| Sample | d50 (μm) | d10 (μm) | d90 (μm) | d10/d50 | d90/d50 | Volume resistivity (Ω · cm) | | L × Idc1 (μH · A) | |
|---|---|---|---|---|---|---|---|---|---|
| No. 23 | 1 | 0.3 | 1.6 | 0.3 | 1.6 | $4.1\times10^{10}$ | ○ | 3.4 | X |
| No. 24 | 2 | 0.6 | 3.2 | 0.3 | 1.6 | $9.3\times10^{9}$ | ○ | 5.0 | X |
| No. 25 | 3 | 0.9 | 4.8 | 0.3 | 1.6 | $5.1\times10^{9}$ | ○ | 7.2 | ○ |
| No. 26 | 4 | 1.2 | 6.4 | 0.3 | 1.6 | $2.2\times10^{9}$ | ○ | 7.5 | ○ |
| No. 27 | 5 | 1.5 | 8 | 0.3 | 1.6 | $9.2\times10^{8}$ | ○ | 7.7 | ○ |
| No. 4 | 10 | 3 | 16 | 0.3 | 1.6 | $5.2\times10^{8}$ | ○ | 8.3 | ○ |
| No. 28 | 15 | 4.5 | 24 | 0.3 | 1.6 | $9.6\times10^{7}$ | ○ | 8.4 | ○ |
| No. 29 | 20 | 6 | 32 | 0.3 | 1.6 | $1.1\times10^{7}$ | ○ | 8.6 | ○ |
| No. 30 | 21 | 6.3 | 33.6 | 0.3 | 1.6 | $9.5\times10^{6}$ | X | 8.7 | ○ |
| No. 31 | 22 | 6.6 | 35.2 | 0.3 | 1.6 | $8.7\times10^{6}$ | X | 8.7 | ○ |

With the aforementioned coil component 10 (Sample No. 4), the Fe—Cr—Si alloy grains used to constitute the magnetic body 12 had a d50 (median diameter) of 10 μm, d10 of 3 μm and d90 of 16 μm when their grain size was considered based on volume. Whether or not effects similar to those explained above could be obtained using grains of a different d50 (median diameter) was checked.

Sample Nos. 23 to 31 shown in Table 2 are coil components having the same structure and made by the same manufacturing method as those used by the aforementioned coil component 10 (Sample No. 4), except that "Fe—Cr—Si alloy grains having a different d50 (median diameter) value from that of the aforementioned coil component 10 (Sample No. 4) were used."

As is evident from the volume resistivity and L×Idc1 values of Sample Nos. 23 to 31, a volume resistivity higher than the aforementioned acceptance judgment criterion for volume resistivity ($1.0\times10^7$ Ω·cm) can be obtained as long as d50 is 20 μm or less, while a L×Idc1 higher than the aforementioned acceptance judgment criterion for L×Idc1 (5.2 μH·A) can be obtained as long as d50 is 3 μm or more. In other words, excellent volume resistivity and L×Idc1 can be obtained as long as d50 (median diameter) is in a range of 3 to 20 μm.

In essence, the above confirms that, as long as d50 (median diameter) when the grain size is considered based on volume is in a range of 3.0 to 20.0 μm, Fe—Cr—Si alloy grains whose d50 (median diameter) is different can be used to achieve the same effects as mentioned above.

A ×3000 SEM observation image showing a cross section of a group of magnetic alloy grains constituting each sample of the above coil component was obtained. The number of magnetic alloy grains 1 in each sample, or N, the number of direct bonding portions of magnetic alloy grains in parts where no oxide film is present, or B, and B/N ratio, are shown in Table 3 below. B and N are described in detail later.

TABLE 3

| Sample No. | N | B | B/N |
|---|---|---|---|
| 1 | 102 | 8 | 0.08 |
| 2 | 81 | 9 | 0.11 |
| 3 | 55 | 7 | 0.12 |
| 4 | 42 | 6 | 0.14 |
| 5 | 38 | 6 | 0.15 |
| 6 | 27 | 5 | 0.20 |
| 7 | 23 | 5 | 0.21 |
| 8 | 15 | 7 | 0.48 |
| 9 | 11 | 6 | 0.51 |
| 10 | 9 | 7 | 0.80 |
| 11 | 80 | 6 | 0.07 |
| 12 | 71 | 8 | 0.11 |
| 13 | 59 | 7 | 0.12 |
| 14 | 37 | 6 | 0.15 |
| 15 | 25 | 5 | 0.19 |
| 16 | 21 | 4 | 0.20 |
| 17 | 19 | 6 | 0.31 |
| 18 | 15 | 6 | 0.42 |
| 19 | 12 | 5 | 0.45 |
| 20 | 8 | 4 | 0.50 |
| 21 | 5 | 3 | 0.57 |
| 22 | 4 | 3 | 0.73 |
| 23 | 98 | 8 | 0.08 |
| 24 | 82 | 6 | 0.07 |
| 25 | 71 | 6 | 0.09 |
| 26 | 55 | 7 | 0.12 |
| 27 | 51 | 6 | 0.12 |
| 28 | 35 | 12 | 0.33 |
| 29 | 21 | 10 | 0.47 |
| 30 | 17 | 9 | 0.55 |
| 31 | 8 | 6 | 0.70 |

[Application to Other Coil Component]

Next, whether or not the ranges of values mentioned in the section "Verification of Optimal Granularity Distribution" and the section "Verification of Optimal Median Diameter" above can be applied (1) when the specific manufacturing method is different from the aforementioned coil component 10 (Sample No. 4), (2) when the type of coil component is the same but the specific structure is different from the aforementioned coil component 10 (Sample No. 4), (3) when grains different from the aforementioned coil component 10 (Sample No. 4) are used for the magnetic body 12, and (4) when the type of coil component is different from the aforementioned coil component 10 (Sample No. 4), is explained.

(1) In the section "Example of Specific Method for Manufacturing Coil Component" above, the composition of magnetic paste was set to 85 percent by weight of Fe—Cr—Si alloy grains, 13 percent by weight of butyl carbitol (solvent) and 2 percent by weight of polyvinyl butyral (binder). However, the weights by percent of solvent and binder can be changed without presenting problems as long as the solvent and binder are removed in the binder removal process, to manufacture the same coil component as the aforementioned coil component 10 (Sample No. 4). The same applies to the composition of conductive paste.

Also, while butyl carbitol was used as the solvent for each paste, any other ether or even alcohol, ketone, ester, etc., can be used without presenting problems, instead of butyl carbitol, as long as it does not chemically react with Fe—Cr—Si alloy grains or Ag grains, and the same coil component as the aforementioned coil component 10 (Sample No. 4) can be manufactured using Pt grains or Pd grains instead of Ag grains.

In addition, while polyvinyl butyral was used as the binder for each paste, any other cellulose resin or even polyvinyl acetal resin, acrylic resin, etc., can be used without presenting problems, instead of polyvinyl butyral, as long as it does not chemically react with Fe—Cr—Si alloy grains or Ag grains, to manufacture the same coil component as the aforementioned coil component 10 (Sample No. 4).

Furthermore, the same coil component as the aforementioned coil component 10 (Sample No. 4) can be manufactured without presenting problems in particular, even when an appropriate amount of any dispersant, such as nonionic surface active agent or anionic surface active agent, is added to each paste.

Moreover, while the conditions of approx. 300° C. for approx. 1 hour were used for the binder removal process, other conditions can be set to manufacture the same coil component as the aforementioned coil component 10 (Sample No. 4), as long as the solvent and binder can be removed.

Also, while the conditions of approx. 750° C. for approx. 2 hours were used for the oxide film forming process, other conditions can be set to manufacture the same coil component as the aforementioned coil component 10 (Sample No. 4), as long as an oxide film of Fe—Cr—Si alloy grain can be formed on the surface of each grain and the properties of Fe—Cr—Si alloy grains do not change.

Furthermore, while the conditions of approx. 600° C. for approx. 1 hour were used for the baking process, other conditions can be set to manufacture the same coil component as the aforementioned coil component 10 (Sample No. 4), as long as the conductive paste can be baked without problems.

In essence, the ranges of values mentioned in the section "Verification of Optimal Granularity Distribution" and the section "Verification of Optimal Median Diameter" above can be applied even when the specific manufacturing method is different from the aforementioned coil component 10 (Sample No. 4).

(2) In the section "Example of Specific Structure of Coil Component" above, the magnetic body 12 had a length of approx. 3.2 mm, width of approx. 1.6 mm and thickness (height) of approx. 0.8 mm. However, the size of the magnetic body 12 has bearing only on the reference value of saturated magnetic flux density of the component itself, so effects equivalent to those mentioned in the section "Effects" above can be achieved even when the size of the magnetic body 12 is changed.

Also, while the coil 13 had approx. 3.5 windings, the number of windings of the coil 13 has bearing only on the reference value of inductance of the component itself, so effects equivalent to those mentioned in the section "Effects" above can be achieved even when the number of windings of the coil 13 is changed, and effects equivalent to those mentioned in the section "Effects" above can be achieved even when the dimensions or shapes of the segments CS1 to CS5 and IS1 to IS4 constituting the coil 13 are changed.

In essence, the ranges of values mentioned in the section "Verification of Optimal Granularity Distribution" and the section "Verification of Optimal Median Diameter" above can be applied even when the type of coil component is the same but the specific structure is different from the aforementioned coil component 10 (Sample No. 4).

(3) In the section "Example of Specific Structure of Coil Component" above, Fe—Cr—Si alloy grains were used to constitute the magnetic body 12, but effects equivalent to those mentioned in the section "Effects" above can be achieved by using, for example, Fe—Si—Al alloy grains or Fe—Ni—Cr alloy grains instead, as long as the saturated magnetic flux density of the magnetic alloy grain material itself is higher than that of the conventional ferrite and an oxide film (=insulation film) is formed on the surface through heat treatment in an oxidizing atmosphere.

In essence, the ranges of values mentioned in the section "Verification of Optimal Granularity Distribution" and the section "Verification of Optimal Median Diameter" above can be applied even when magnetic alloy grains different from the aforementioned coil component 10 (Sample No. 4) are used for the magnetic body 12.

(4) In the section "Example of Specific Structure of Coil Component" above, the coil component 10 was of the laminated type, but effects equivalent to those mentioned in the section "Effects" above can be achieved by adopting the present invention to a coil component of the powder-compacted type, for example, as long as the type of coil component is such that a helical coil is directly contacting a magnetic body. Here, a "coil component of the powder-compacted type" refers to a coil component structured in such a way that a prepared helical coil wire is buried in a magnetic body made of magnetic powder using a press machine and, as long as Fe—Cr—Si alloy grains are used as the magnetic powder to constitute the magnetic body and the magnetic body is pressed and then heat-treated under the same conditions as those used in the aforementioned oxide film forming process, effects equivalent to those mentioned in the section "Effects" above can be achieved.

In essence, the ranges of values mentioned in the section "Verification of Optimal Granularity Distribution" and the section "Verification of Optimal Median Diameter" above can be applied even when the type of coil component is different from the aforementioned coil component 10 (Sample No. 4).

[Specific Example of Coil Component of Winding Type]

Next, a specific example of a winding chip inductor, which is a coil component, is explained.

Figure 8:
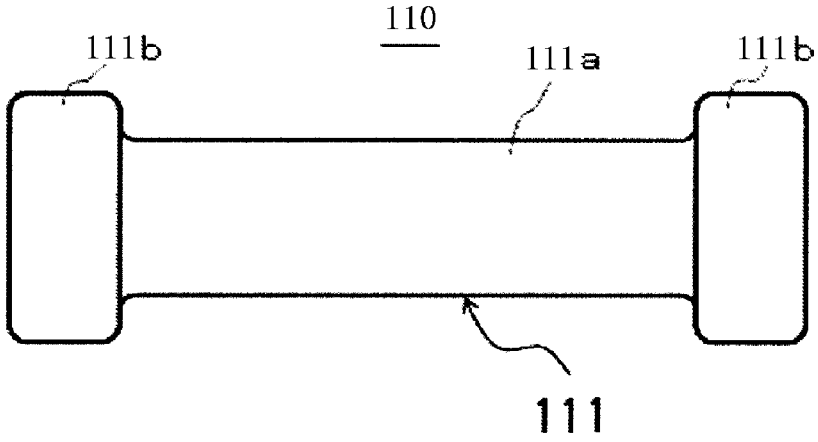
FIG. 8 is a side view showing the exterior of the magnetic body of a coil component of the winding type.
Figure 9:
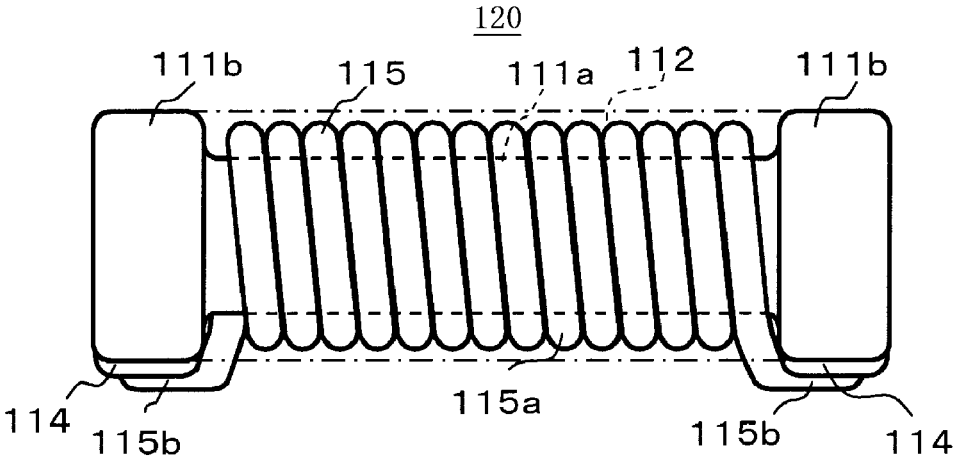
FIG. 9 is a perspective side view showing a part of a coil component of the winding type.
Figure 10:
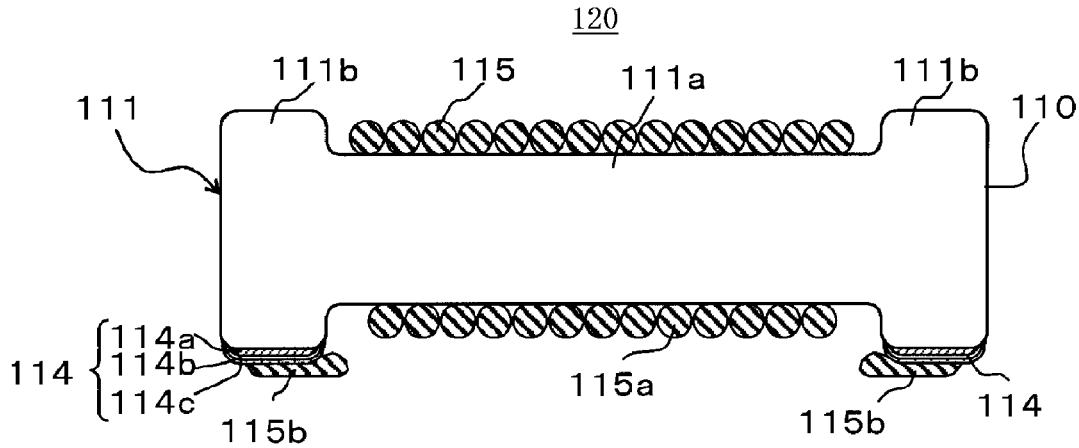
FIG. 10 is a longitudinal section view showing the internal structure of the coil component in FIG. 9.

FIG. 8 is a side view showing the exterior of a magnetic body manufactured in this example. FIG. 9 is a perspective side view showing a part of an example of coil component manufactured in this example. FIG. 10 is a longitudinal section view showing the internal structure of the coil component in FIG. 9. A magnetic body 110 shown in FIG. 8 is used as the magnetic core around which the coil of the winding chip inductor is wound. A drum-shaped magnetic core 111 has a sheet-like winding core 111*a* around which a coil provided in parallel on the mounting surface of a circuit board, etc., is wound, and a pair of flange parts 111*b* provided at the opposing ends of the winding core 111*a*, respectively, and the foregoing parts together form a drum shape. The coil ends are electrically connected to external conductive films 114 formed on the surfaces of the flange parts 111*b*. The size of the winding core 111*a* was set to 1.0 mm in width, 0.36 mm in height and 1.4 mm in length. The size of the flange part 111*b* was set to 1.6 mm in width, 0.6 mm in height, and 0.3 mm in thickness.

A winding chip inductor 120, which is a coil component, has the aforementioned magnetic core 111 and a pair of sheet-like magnetic cores 112 that are not illustrated. These magnetic core 111 and sheet-like magnetic cores 112 were manufactured as follows.

The same Fe—Cr—Si alloy grains used in manufacturing example "No. 4" among the aforementioned manufacturing examples of laminated inductors were used for material grains. Note that when the surface of an aggregate made of this alloy powder was analyzed by XPS and $Fe_{Metal}/(Fe_{Metal}+Fe_{Oxide})$ (explained later) was calculated, the result was 0.25. One hundred parts by weight of these material grains were mixed and agitated with 1.5 parts by weight of an acrylic binder whose thermal decomposition temperature was 400° C., to which 0.5 parts by weight of Zn stearate was added as a lubricant. Thereafter, the mixture was formed into a specific shape under 8 t/cm$^2$, and heat-treated for 1 hour at 750° C. in an oxidizing atmosphere of 20.6% in oxygen concentration, to obtain magnetic alloy grains. When the characteristics of the obtained magnetic alloy grains were measured, the magnetic permeability of 36 before heat treatment increased to 48 after heat treatment. The specific resistance was $2\times10^5$ Ωcm and strength was 7.5 kgf/mm$^2$. A ×3000 SEM observation image showing a cross section of a group of magnetic alloy grains was obtained to confirm that the number of magnetic alloy grains 1, or N, was 42, the number of direct bonding portions of magnetic alloy grains, or B, was 6, and B/N ratio was 0.14. A composition analysis of the oxide film on the obtained magnetic alloy grains found that 1.5 mol of Cr element was contained per 1 mol of Fe element. These magnetic alloy grains were used for the magnetic core. The sheet-like magnetic core 112 connects the flange parts 111*b*, 111*b* at both ends of the magnetic core 111. The size of the sheet-like magnetic core 112 was set to 2.0 mm in length, 0.5 mm in width, and 0.2 mm in thickness. A pair of external conductive films 114 is formed on the mounting surfaces of the flange parts 111*b* of the magnetic core 111. Also, a coil 115 constituted by an insulating covering conductive wire is wound around the winding core 111*a* of the magnetic core 111 to form a winding part 115*a*, while both ends 115*b* are thermo-compression-bonded to the external conductive films 114 on the mounting surfaces of the flange parts 111*b*. The external conductive films 114 each have a baked conductive layer 114*a* formed on the surface of the magnetic body 110, as well as a Ni plating layer 114*b* and a Sn plating layer 114*c* laminated on this baked conductive layer 114*a*. The sheet-like magnetic cores 112 are bonded to the flange parts 111*b*, 111*b* of the magnetic core 111 via resin adhesive. The external conductive films 114 are formed on the surface of the magnetic body 110 and the ends of the magnetic core are connected to the external conductive films 114. The external conductive films 114 were formed by baking a paste, constituted by silver and glass added to it, onto the magnetic body 110 at a specified temperature. Specifically when the baked conductive layer 114*a* of the external conductive film 114 on the surface of the magnetic body 110 was manufactured, a bake-type electrode material paste containing magnetic alloy grains and glass frit (bake-type Ag paste was used in this example) was coated onto the mounting surface on the flange part 111*b* of the magnetic core 111 constituted by the magnetic body 110, and then heat-treated in atmosphere to sinter and fix the electrode material directly onto the surface of the magnetic body 110. This way, a winding chip inductor was manufactured as a coil component.

A favorable embodiment of magnetic alloy grains under the present invention is derived by referring to the above examples.

Figure 11:
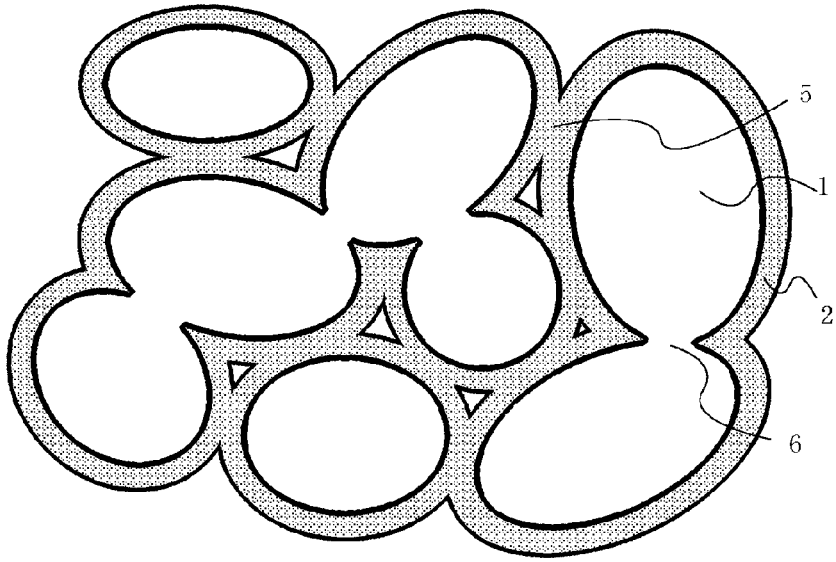
FIG. 11 is a schematic section view of the fine structure of a magnetic body in an embodiment of the present invention.

FIG. 11 is a schematic section view showing the fine structure of a magnetic body in an example of the present invention. Under the present invention, microscopically the magnetic alloy grains 1 are understood as an aggregate of many inter-connected magnetic alloy grains 1 that were originally independent, where individual magnetic alloy grains 1 have an oxide film 2 formed almost entirely around them and this oxide film 2 ensures insulation property of the magnetic alloy grains 1. Adjacent magnetic alloy grains 1 constitute magnetic alloy grains 1 of a specific shape, bonded mainly by means of bonds via the oxide film 2 around each magnetic alloy grain 1. In a favorable embodiment, adjacent magnetic alloy grains 1 are partially bonded at metal parts where no oxide film is present (reference numeral 6). In this Specification, "magnetic alloy grains 1" means grains made of the aforementioned alloy material and when non-existence of oxide film 2 is to be emphasized, the terms "metal parts" or "cores" may be used. Conventional magnetic alloy grains are such that magnetic grains or several aggregates of magnetic grains are dispersed in a matrix of hardened organic resin. Under the present invention, it is desirable that such matrix of organic resin substantially not be present.

Preferably the individual magnetic alloy grains 1 should be made of a Fe—Si-M soft magnetic alloy. Here, M is a metal element oxidized more easily than Fe, and typically it is Cr (chromium), Al (aluminum) or Ti (titanium), etc., but preferably Cr or Al.

In the Fe—Si-M soft magnetic alloy, the remainder of Si and metal M should preferably be Fe, except for unavoidable impurities. Metals that may be contained other than Fe, Si and M include Mn (manganese), Co (cobalt), Ni (nickel) and Cu (copper), among others.

The chemical composition of the alloy constituting each magnetic alloy grain 1 of the magnetic alloy grains 1 may be calculated by, for example, capturing a cross sectional image of the magnetic alloy grains 1 using a scanning electron microscope (SEM) and then analyzing the image by energy dispersive X-ray spectrometry (EDS) via the ZAF method.

An oxide film 2 is present either partially or entirely around (the surface of) each individual magnetic alloy grain 1 constituting the magnetic alloy grains 1. It can also be described as follows: There is a core constituted by the aforementioned soft magnetic alloy (i.e. magnetic alloy grains 1) and an oxide film 2 is formed around this core. The oxide film 2 may be formed in the material grain stage before magnetic alloy grains 1 are formed, or the oxide film 2 may be generated in the forming stage where oxide film is kept non-existent or at an extremely low level in the material grain stage. Presence of this oxide film 2 can be recognized by a contrast (brightness) difference in a scanning electron microscope (SEM) image of approximately x3000 in magnification. Presence of an oxide film 2 ensures insulation property of the magnetic body as a whole.

The oxide film 2 is an oxide of the magnetic alloy constituting the magnetic alloy grains, and preferably the oxide film 2 should be an oxide of Fe—Si-M soft magnetic alloy (where M is a metal element more easily oxidized than Fe), where the mol ratio of the metal element denoted by M relative to the Fe element is greater than the corresponding mol ratio in the magnetic alloy grain. To obtain an oxide film 2 having such structures, the material grains used to obtain the magnetic body should contain as little Fe oxide as possible, or should not contain any Fe oxide whenever possible, and the alloy surface should be oxidized by means of heat treatment, etc., in the process of obtaining magnetic alloy grains 1. Such processing allows metal M, which is more easily oxidized than Fe, to be oxidized selectively, and consequently increases the mol ratio of metal M to Fe in the oxide film 2 relative to the mol ratio of metal M to Fe in the magnetic alloy grain 1. It is advantageous to contain more of the metal element denoted by M than Fe element in the oxide film 2, because it suppresses excessive oxidization of alloy grains.

The method for measuring the chemical composition of the oxide film 2 on magnetic alloy grains 1 is as follows. First, magnetic alloy grains 1 are fractured or otherwise have their cross sections exposed. Next, the surface is smoothed by ion milling, etc., and captured by a scanning electron microscope (SEM), after which the oxide film 2 is analyzed by energy dispersive X-ray spectroscopy (EDS) to calculate the composition using the ZAF method.

The content of metal M in the oxide film 2 should be preferably in a range of 1.0 to 5.0 mol, or more preferably in a range of 1.0 to 2.5 mol, or even more preferably in a range of 1.0 to 1.7 mol, per 1 mol of Fe. Increasing the aforementioned content is desirable in the sense that it suppresses excessive oxidization, while decreasing the aforementioned content is desirable from the viewpoint of sintering between magnetic alloy grains. Methods to increase the aforementioned content include, for example, applying heat treatment in a weak oxidizing atmosphere, while methods to decrease the aforementioned content include, for example, applying heat treatment in a strong oxidizing atmosphere.

Magnetic alloy grains 1 are bonded to each other mainly by means of bonds 5 via an oxide film 2. The presence of bonds 5 via an oxide film 2 can clearly be determined by, for example, visually confirming that the oxide films 2 on adjacent magnetic alloy grains 1 have the same phase in an approx. ×3000 SEM observation image, etc. Even when the oxide films 2 on adjacent magnetic alloy grains 1 are contacting each other, it cannot be considered a bond 5 via an oxide film 2 in locations where an interface between adjacent oxide films 2 is visually recognized in the SEM observation image. The presence of bonds 5 via an oxide film 2 improves mechanical strength and insulation property. Although it is desirable for adjacent magnetic alloy grains 1 to be bonded via their oxide films 2 across all magnetic alloy grains 1, mechanical strength and insulation property will improve sufficiently as long as grains are partially bonded this way, and this pattern is also considered an embodiment of the present invention. Also, as explained later, magnetic alloy grains 1 are also partially bonded to each other not via oxide film 2. Furthermore, it is acceptable for another pattern to be partially present where magnetic alloy grains 1 do not have any bond via an oxide film 2 or direct bond of magnetic alloy grains 1 but they are only physically contacting or close to each other.

Ways to generate bonds 5 via an oxide film 2 include, for example, applying heat treatment at the specified temperature described later in an oxygen atmosphere (such as in air) when magnetic alloy grains 1 are manufactured. Preferably the aforementioned bonds 5 should be via an oxide film newly generated during heat treatment after forming. In other words, it is desirable to generate a new oxide film by oxidization during heat treatment over areas where no oxide film was generated during forming before heat treatment (=areas of magnetic alloy), so that bonds are generated via this newly generated oxide film. Here, "forming before heat treatment" means, according to the aforementioned example, creating sheets from a magnetic paste and then laminating and pressure-bonding these sheets to manufacture a laminated inductor, or mixing magnetic alloy grains with a binder, etc., and then forming the mixture into a specific shape to manufacture a winding coil, for example. Magnetic alloy grains used in this forming before heat treatment, or specifically forming under an unheated condition, should desirably have no oxide film at least on a part of their grain surface. It is desirable to perform forming under an unheated condition using these grains and then apply heat treatment. Here, "under an unheated condition" refers to a temperature where magnetic alloy substantially does not undergo oxidization reaction, such as 120° C. or below, for example. Desirably such heat treatment should generate a new oxide film in areas on the surface of magnetic alloy grains where oxide film was not present before, in order to generate bonds via the newly generated oxide film mentioned above between adjacent magnetic alloy grains.

According to a favorable embodiment, not only bonds 5 via an oxide film 2, but also direct bonds 6 of magnetic alloy grains 1, are present among magnetic alloy grains 1. As mentioned above in connection with a bond 5 via an oxide film 2, presence of a direct bond 6 of magnetic alloy grains 1 can be clearly determined by, for example, taking a photograph of a cross section in the form of approx. ×3000 SEM observation image and recognizing relatively deep concaved parts along the curves drawn by grain surfaces, and then visually confirming a point of connection not via oxide film between adjacent magnetic alloy grains 1 in a location where the surface curves of two grains intersect each other. Presence of direct bonds 6 of adjacent magnetic alloy grains 1 improves magnetic permeability, which is one key effect of this favorable embodiment.

Ways to generate direct bonds 6 of magnetic alloy grains 1 include, for example, using grains having less oxide film as material grains, adjusting the temperature and oxygen partial pressure mentioned later during heat treatment when magnetic alloy grains 1 are manufactured, and adjusting the forming density when magnetic alloy grains 1 are obtained from material grains. The heat treatment temperature should preferably be such that magnetic alloy grains 1 are bonded to each other easily and oxide does not generate easily, and a specific range of favorable temperatures will be mentioned later. As for oxygen partial pressure, it can be the oxygen partial pressure in air, for example, where the lower the oxygen partial pressure, the less easily an oxide generates and consequently the more easily magnetic alloy grains 1 are bonded to each other.

According to a favorable embodiment of the present invention, a majority of bonds between adjacent magnetic alloy grains 1 are bonds 5 via an oxide film 2, and direct bonds 6 of magnetic alloy grains are partially present. The degree of direct bonds 6 of magnetic alloy grains can be quantified as follows. Magnetic alloy grains 1 are cut and a SEM observation image showing an enlarged view of the cross section at approx. ×3000 magnification is obtained. With the SEM observation image, the field of view and other conditions are adjusted so that 30 to 100 magnetic alloy grains 1 are captured. The number of magnetic alloy grains 1 in the observation image, or N, and the number of direct bonds 6 of magnetic alloy grains 1, or B, are counted. The B/N ratio based on these values is used as an evaluation indicator for the degree of direct bonds 6 of magnetic alloy grains. How to count N and B mentioned above is explained by using the embodiment in FIG. 11 as an example. When the image shown in FIG. 11 is obtained, the number of magnetic grains 1, or N, is 8, whereas the number of direct bonds 6 of magnetic alloy grains 1, or B, is 4. Accordingly, the aforementioned B/N ratio is 0.5 in this embodiment. Under the present invention, the aforementioned B/N ratio should be preferably in a range of 0.1 to 0.5, or more preferably in a range of 0.1 to 0.35, or even more preferably in a range of 0.1 to 0.25. Since a greater B/N is associated with improved magnetic permeability while a smaller B/N is associated with improved insulation resistance, the aforementioned range is presented as favorable in order to achieve good magnetic permeability and good insulation resistance at the same time.

Material grains used to obtain magnetic alloy grains are manufactured by the atomization method. As mentioned above, magnetic alloy grains 1 not only have bonds 5 via an oxide film 2, but they also have direct bonds 6 of magnetic alloy grains 1. Accordingly, although material grains can have some oxide film formed on them, it is desirable that such oxide film be not excessive. Grains manufactured by the atomization method are preferred because they have relatively less oxide film. The ratio of the core constituted by an alloy and oxide film of the material grain can be quantified as follows. The material grain is analyzed by XPS (analyzing compositions of a surface layer having a depth of several nm) and, by focusing on the peak intensity of Fe on the surface of an individual grain, the integral value $Fe_{Metal}$ at the peak (706.9 eV) where Fe is present as metal on the surface, and integral value $Fe_{oxide}$ at the peak where Fe is present as oxide on the surface, are obtained, to quantify the above ratio by calculating $Fe_{Metal}/(Fe_{Metal}+Fe_{Oxide})$. Here, when calculating $Fe_{oxide}$, fitting is performed to match the measured data as a superposition of normal distributions of three types of oxides, namely $Fe_2O_3$ (710.9 eV), FeO (709.6 eV) and $Fe_3O_4$ (710.7 eV), based on coupling energy. As a result, $Fe_{oxide}$ is calculated as a sum of integrated areas after peak separation. The aforementioned value should preferably be 0.2 or more in order to facilitate generation of direct bonds 6 of alloys during heat treatment and consequently enhance magnetic permeability. The upper limit is not specifically set for the aforementioned value, but an upper limit of 0.6, for example, may be used to facilitate manufacturing, and a preferred value of upper limit is 0.3. Means to increase the aforementioned value include applying heat treatment in a reducing atmosphere, removing the oxide layer on the surface by acid, or adding other chemical treatment, among others. Reduction treatment may be implemented by, for example, holding for 0.5 to 1.5 hours in an atmosphere of nitrogen or argon containing 25 to 35% of hydrogen at 750 to 850° C. Oxidization treatment may be implemented by, for example, holding for 0.5 to 1.5 hours in air at 400 to 600° C.

The aforementioned material grains may be obtained by any known method for manufacturing alloy grains, or commercial products may be used such as PF20-F by Epson Atmix Corp., and SFR—FeSiAl by Nippon Atomized Metal Powders Corp. When using commercial products, however, desirably material grains should be screened and also the aforementioned heat treatment, chemical treatment or other pre-processing should be added, because it is highly likely that these products do not consider the aforementioned value of $Fe_{Metal}/(Fe_{Metal}+Fe_{oxide})$.

The oxide film included in the material grains ("the initial oxide film") is different from the oxide layer of the heat-treated grains ("the heat-generated oxide layer"). In some embodiments, the heat-generated oxide layer contains a lower concentration of chrome and a higher concentration of iron than those in the initial oxide film; however, because the quantity of the heat-generated oxide layer is greater than that of the initial oxide film, the total quantity of chrome contained in the heat-generated oxide layer is greater than that of the initial oxide film. In some embodiments, the material grains are selected and the heat-treatment of the material grains is conducted so that as the heat-generated oxide layer grows, it absorbs the initial oxide film therein, whereby the initial oxide film vanishes.

In this disclosure, regarding distribution of grain sizes, d10, d50, and d90 represent the $10^{th}$ percentile size, $50^{th}$ percentile size, and $90^{th}$ percentile size based on volume, respectively, and the size refers to a size of initial magnetic alloy grains which include an oxide film, if any, formed on a part of the surface of each initial magnetic alloy grain. In some embodiments, the "oxide film" does not refer to a completely continuous film enclosing the grains but refers to a patched coating having a hole or holes through which a surface of the grains is exposed.

The method to obtain a formed product from material grains is not at all limited, and the aforementioned examples of manufacturing laminated inductor and winding coil may be referenced or any other known means for manufacturing magnetic alloy grains may be incorporated as deemed appropriate.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments.

The present application claims priority to Japanese Patent Application No. 2011-009886, filed Jan. 20, 2011, Japanese Patent Application No. 2011-232371, filed Oct. 24, 2011, and Japanese Patent Application No. 2011-236738, filed Oct. 28, 2011, each disclosure of which is incorporated herein by reference in its entirety. In some embodiments, as the magnetic body, those disclosed in co-assigned U.S. patent application Ser. No. 13/092,381, No. 13/277,018, and No. 13/313,982 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising a magnetic body mainly constituted by magnetic alloy grains, and a coil formed on the magnetic body;

wherein an oxide film of the magnetic alloy grains is present on a surface of each of the magnetic alloy grains, and based on grain size by volume standard, the magnetic alloy grains have a d50 in a range of 3.0 to 20.0 μm, d10/d50 in a range of 0.1 to 0.7, and d90/d50 in a range of 1.4 to 5.0, wherein d10, d50, and d90 represent the $10^{th}$ percentile size, $50^{th}$ percentile size, and $90^{th}$ percentile size based on volume, respectively.

2. The coil component according to claim 1, wherein the magnetic alloy grains are bonded to each other via the oxide film which is generated by heat-treating magnetic alloy grains formed under an unheated condition and having no oxide film at least on a part of the surface of each magnetic alloy grain.

3. The coil component according to claim 1, wherein the oxide film is made of an oxide of Fe—Si-M soft magnetic alloy (where M is a metal element more easily oxidized than Fe), where the mol ratio of the metal element denoted by M relative to the Fe element is greater in the oxide film than the corresponding mol ratio in the magnetic alloy grains.

4. The coil component according to claim 2, wherein the oxide film is made of an oxide of Fe—Si-M soft magnetic alloy (where M is a metal element more easily oxidized than Fe), where the mol ratio of the metal element denoted by M relative to the Fe element is greater in the oxide film than the corresponding mol ratio in the magnetic alloy grains.

5. The coil component according to claim 1, wherein the magnetic alloy grains have bonds via oxide films present on the surfaces of adjacent magnetic alloy grains, as well as direct bonds bonding adjacent magnetic alloy grains in parts where no oxide film is present.

6. The coil component according to claim 2, wherein the magnetic alloy grains have bonds via oxide films present on the surfaces of adjacent magnetic alloy grains, as well as direct bonds bonding adjacent magnetic alloy grains in parts where no oxide film is present.

7. The coil component according to claim 3, wherein the magnetic alloy grains have bonds via oxide films present on the surfaces of adjacent magnetic alloy grains, as well as direct bonds bonding adjacent magnetic alloy grains in parts where no oxide film is present.

8. The coil component according to claim 4, wherein the magnetic alloy grains have bonds via oxide films present on the surfaces of adjacent magnetic alloy grains, as well as direct bonds bonding adjacent magnetic alloy grains in parts where no oxide film is present.

9. The coil component according to claim 5, wherein a B/N ratio, where N represents the number of magnetic alloy grains shown in a cross section of a group of magnetic alloy grains and B represents the number of direct bonds bonding adjacent magnetic alloy grains in parts where no oxide film is present, is in a range of 0.1 to 0.5.

10. The coil component according to claim 6, wherein a B/N ratio, where N represents the number of magnetic alloy grains shown in a cross section of a group of magnetic alloy grains and B represents the number of direct bonds bonding adjacent magnetic alloy grains in parts where no oxide film is present, is in a range of 0.1 to 0.5.

11. The coil component according to claim 7, wherein a B/N ratio, where N represents the number of magnetic alloy grains shown in a cross section of a group of magnetic alloy grains and B represents the number of direct bonds bonding adjacent magnetic alloy grains in parts where no oxide film is present, is in a range of 0.1 to 0.5.

12. The coil component according to claim 8, wherein a B/N ratio, where N represents the number of magnetic alloy grains shown in a cross section of a group of magnetic alloy grains and B represents the number of direct bonds bonding adjacent magnetic alloy grains in parts where no oxide film is present, is in a range of 0.1 to 0.5.

13. The coil component according to claim 1, wherein the magnetic alloy grains are Fe—Cr—Si alloy grains.

14. The coil component according to claim 1, wherein the magnetic alloy grains are obtained by forming a plurality of magnetic alloy grains manufactured by the atomization method and then applying heat treatment to the plurality of magnetic alloy grains in an oxidizing atmosphere.

15. A method for producing a magnetic body for a coil component, wherein the magnetic body is mainly constituted by magnetic alloy grains, an oxide film of which magnetic alloy grains are present on a surface of each of the magnetic alloy grains, and based on grain size by volume standard, the magnetic alloy grains have a d50 in a range of 3.0 to 20.0 μm, d10/d50 in a range of 0.1 to 0.7, and d90/d50 in a range of 1.4 to 5.0, wherein dl 0, d50, and d90 represent the $10^{th}$ percentile size, $50^{th}$ percentile size, and $90^{th}$ percentile size based on volume, respectively, said method comprising:

providing initial magnetic alloy grains formed under an unheated condition, said initial magnetic alloy grains including no oxide film at least on a part of the surface of each initial magnetic alloy grain; and applying a heat treatment to the initial magnetic alloy grains to generate an oxide film on the surface of the initial magnetic alloy grains and to bond adjacent initial magnetic alloy grains to each other via the oxide film.

16. The method according to claim 15, wherein the unheated condition is a non-oxidizing condition.

17. The method according to claim 15, wherein the initial magnetic alloy grains are Fe—Si-M alloy grains (where M is a metal element more easily oxidized than Fe).

18. The method according to claim 17, wherein a mass ratio of Fe in metal form to Fe in both metal form and oxide form on an exposed surface of individual initial magnetic alloy grains before the heat treatment is 0.2 to 0.6.

19. A method for producing a magnetic body for a coil component, wherein the magnetic body is mainly constituted by magnetic alloy grains, an oxide film of which magnetic alloy grains are present on a surface of each of the magnetic alloy grains, and based on grain size by volume standard, the magnetic alloy grains have a d50 in a range of 3.0 to 20.0 μm, d10/d50 in a range of 0.1 to 0.7, and d90/d50 in a range of 1.4 to 5.0, wherein d10, d50, and d90 represent the $10^{th}$ percentile size, $50^{th}$ percentile size, and $90^{th}$ percentile size based on volume, respectively, said method comprising:

providing a plurality of magnetic alloy grains formed by the atomization method; and applying heat treatment to the plurality of magnetic alloy grains in an oxidizing atmosphere to generate an oxide film on the surface of the initial magnetic alloy grains and to bond adjacent initial magnetic alloy grains to each other via the oxide film.

* * * * *